United States Patent [19]

Fujita et al.

[11] 4,276,854

[45] Jul. 7, 1981

[54] APPARATUS FOR DETECTING TONER DENSITY

[75] Inventors: Hisao Fujita; Yasuhiko Tanaka; Isao Kobayashi; Ken Nakamura, all of Hachioji, Japan

[73] Assignee: Konishiroku Photo Industry Co., Ltd., Tokyo, Japan

[21] Appl. No.: 93,809

[22] Filed: Nov. 13, 1979

[30] Foreign Application Priority Data

Nov. 15, 1978 [JP] Japan ..... 53/156048[U]

[51] Int. Cl.[3] ..... B05C 11/00; G03G 15/09

[52] U.S. Cl. ..... 118/689; 118/658; 355/3 DD

[58] Field of Search ..... 118/689, 690, 658; 222/DIG. 1; 355/3 DD

[56] References Cited

U.S. PATENT DOCUMENTS 4,147,127 4/1979 Terashima ..... 118/689

4,226,525 10/1980 Sakamoto et al. ..... 118/689 X

FOREIGN PATENT DOCUMENTS 2815841 10/1978 Fed. Rep. of Germany ..... 118/690

*Primary Examiner*—Evan K. Lawrence

*Attorney, Agent, or Firm*—Bierman & Bierman

[57] ABSTRACT

An apparatus for detecting the density (concentration) of toner in a developer for an electrostatic recording apparatus includes an operatively moveable surface for carrying developer onto an electrostatic latent image bearing member during image development, a scraper element having at least a flat surface for scraping developer from the movable surface in a substantially steady and uniform stream along the flat face, and a substantially flat detection coil assembly having oppositely-directed faces. The coil assembly is mounted on, spaced apart from, and substantially parallel to the flat face of the scraper so that the stream of developer passes along both coil assembly faces directly after being scraped from the moveable surface, thereby enhancing the toner density detection sensitivity of the coil assembly.

4 Claims, 9 Drawing Figures

APPARATUS FOR DETECTING TONER DENSITY

BACKGROUND OF THE INVENTION

1. Field of the Invention

The present invention relates to a toner density detecting apparatus to be used in an electrophotographic copying machine and an electrostatic recording apparatus.

2. Description of the Prior Art

In general, in the transfer type electrophotographic copying apparatus and the electrostatic recording apparatus, a developer containing a magnetic carrier material and an electrically insulative coloring toner is used for converting an electrostatic latent image produced on a light- or photo-sensitive medium into a visible image. The toner material is electrostatically attracted onto the electrostatic latent image corresponding to an original to be copied. Then the latent image which has become a visible image (toner image) is transferred onto a copying sheet (plain paper) and thermally fused thereon. In order to attain a constant image density in the replica as produced in the copying or recording system of the above type, it is necessary to measure the density or concentration of the toner contained in the developer as the toner is consumed thereby to supplement the toner so as to maintain the toner concentration or density substantially constant. Heretofore, various toner density detecting systems have been proposed.

As one of the toner density detecting methods, it is known to detect a variation in permeability of the developer as a variation in inductance of a coil since the permeability of the developer varies as a function of toner concentration (refer to Japanese Patent Publication No. 8280/1971, for example.). Since the development of a latent image by using a developer is usually effected when a photo-sensitive medium carrying an electrostatic latent image thereon is being moved together with the developer in contact with the latent image, it is necessary to produce a steady and uniform flow of the developer through the coil which is to be detected to measure the concentration or density of the toner in accordance with the method described above. Apparatus implemented on this principle are disclosed in Japanese Laid-Open Patent Exposure No. 123242/1977. Typical examples of such prior art toner density detecting systems are schematically illustrated in FIGS. 1 to 3 and 5 of the accompanying drawings. In the Figures, identical reference numerals denote the same or similar parts.

Referring first, to FIG. 1, a rotatable sleeve 2 having an inner magnetic assembly or magnet assembly including a plurality of permanent magnets 1 disposed therein is located so as to transport the developer 4 from a developer container 3 to a region of a photosensitive medium or an electrostatic recording medium 5 in which an electrostatic latent image 6 to be developed is produced. Thus, the developer is caused to contact the latent image to convert it into a corresponding toner image. After development, the residual developer is scraped from the sleeve 2 by means of a scraper 7, a fraction of which is introduced into a passage defined by a coil bobbin 8 on which a coil 9 is wound. Passage of the developer 4 through the bobbin 8 will bring about a variation in the inductance of the coil 9, which variation is measured by an external detecting circuit (not shown) to thereby control the toner density. Reference numeral 10 denotes a fluffing restricting plate (thickness regulating plate) for regulating the thickness of the flowing developer layer. In the case of the toner density detecting system illustrated in FIG. 1, special means having an expensive and complicated structure is required for attaining a steady and uniform flow of the developer through the coil bobbin 8, which necessarily involves a large and complex developing device. Further, because the measurement of the inductance of the coil 9 must be delayed until the bobbin 8 has been filled with the developer and the developer has fallen to a position at which the coil 9 is disposed, a time lag is involved in the measurement, accompanied by a disadvantageously deteriorated measurement accuracy.

In an attempt to avoid the shortcomings described above, there have been proposed the apparatus shown in FIGS. 2 and 3, in which the inherent flow of the developer within the developing device is used for the detection of the toner density without resorting to the use of a flow deflecting means such as the scraper 7 shown in FIG. 1. Referring to FIGS. 2 and 3, a flat coil 9' is employed which undergoes variation in the inductance thereof. In the case of the arrangement shown in FIG. 2, the flat coil 9' is mounted on the thickness regulating plate 10, while in the case of the apparatus shown in FIG. 3 the flat coil 9' is mounted on the bottom plate of the developer container 3 in such a position as not to obstruct the flow of the developer. By the way, the flat coil itself has been hitherto known and may be composed of a planar winding embedded or wrapped in a rectangular flat plate 11 formed of a plastic material as is shown in FIG. 4. Alternatively, a printed coil may of course be used. The arrangements shown in FIGS. 2 and 3 are certainly advantageous in that the provision of the coil 9' does not interfere with the flow of the developer. However, because only one face of the flat coil is used for the detection of the toner density, it is difficult to attain a sufficiently high sensitivity in the detection system. Moreover, in the case of the apparatus shown in FIG. 2, the function of the plate 10 for restricting the fluffing of the developer might be adversely influenced due to the provision of the coil. Furthermore, the permanent magnets (indicated by the broken or imaginary lines) constituting the magnet roll assembly 1 are likely to interfere with the measurement, making it difficult to detect the toner density with a desired high accuracy. On the other hand, in the case of the arrangement shown In FIG. 3, remarkable turbulences will occur at the region located below the rotating sleeve 2 due to various flows of the developer such as the feeding flow toward the rotating sleeve, dropping of the developer from the fluffing or thickness regulating plate 10 and the flow caused under the action of the permanent magnets of the rotating sleeve 2, whereby a significant degradation in S/N ratio will result. Additionally, a preset relationship between the toner density and the inductance of the coil may undergo irregular variations, whereby a slight change in the toner content may give rise to a significant deviation in the measured density.

As another approach for overcoming the drawbacks described above, there also has been proposed an arrangement shown in FIG. 5 in which a flow rectifying plate 12 is disposed in opposition and parallel to the scraper plate 7 with flat coils 9', such as the one shown in FIG. 4, being mounted on the lower surface of the scraper 7 and on the upper surface of the flow rectifying plate 12, respectively, whereby a fraction of the developer is caused to flow between the scraper 7 and the rectifying plate 12. By virtue of the fact that two coils are used, the apparatus shown in FIG. 5 can enjoy a high sensitivity. However, this structure suffers from disadvantages in that the developing device becomes complicated in structure and expensive in manufacturing costs.

SUMMARY OF THE INVENTION

Accordingly, an object of the present invention is to provide a toner density or concentration detecting apparatus which is immune to the disadvantages of th prior art apparatus such as described above and which can be implemented inexpensively in a simplified structure while assuring a high accuracy in the measurement. According to the present invention, it is proposed that a flat detector member for a magnetic material be disposed in the flow of developer with flat surfaces being in parallel with the flowing direction of the developer. With the arrangement of the detecting member of a flat configuration along the flowing direction of the developer, a steady and uniform flow of the developer can be assured along the detector surface without using any specific flow rectifying means.

DESCRIPTION OF THE PREFERRED EMBODIMENTS

Figure 1:
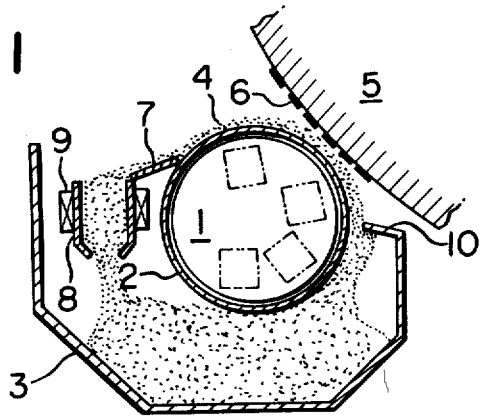
FIGS. 1 to 3 and 5 show, schematically, arrangements of hitherto known toner density detecting apparatus.
Figure 2:
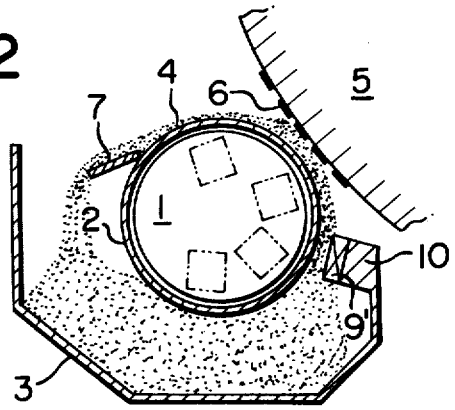
Figure 3:
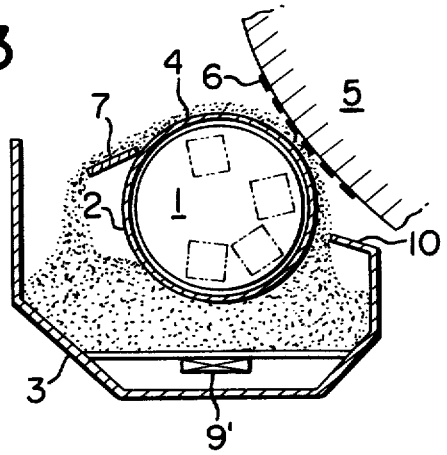
Figure 4:
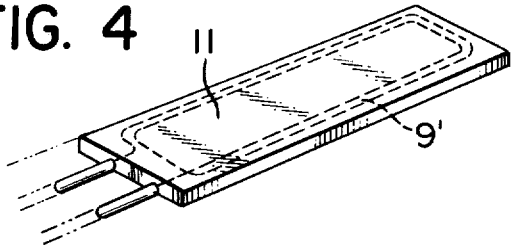
FIG. 4 is a perspective view showing a flat coil assembly used in the toner density detection system.
Figure 5:
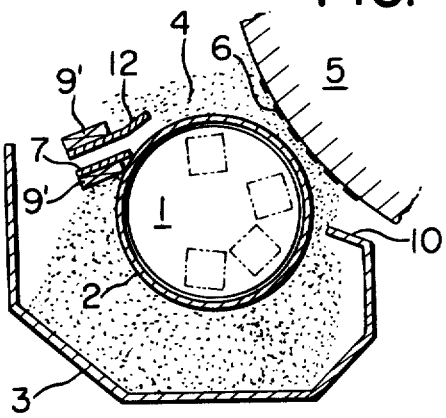
Figure 6:
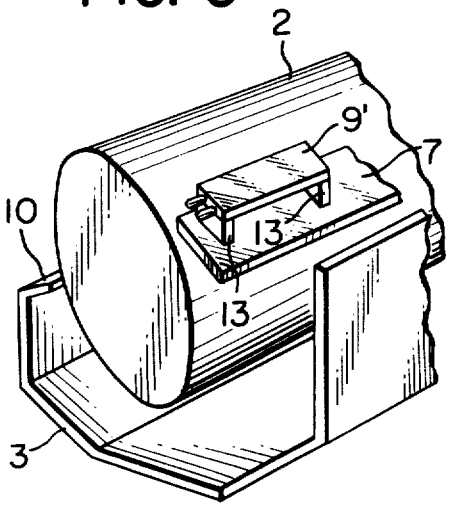
FIG. 6 is a perspective view showing schematically an arrangement of a toner density detecting system according to the present invention.
Figure 7:
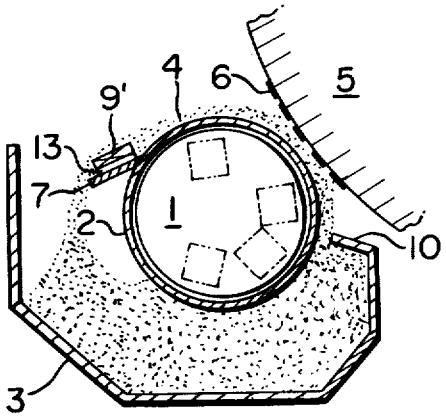
FIG. 7 is a side view of the same, FIG. 8 graphically illustrates detecttion sensitivity of a toner density detecting system according to the present invention as compared with that of a hitherto known system.

The present invention will now be described in detail in conjunction with preferred embodiments thereof shown in FIGS. 6 to 9. Referring to FIGS. 6 and 7, a flat coil assembly 9' which may be of a structure such as shown in FIG. 4 is mounted on the scraper plate 7 with a distance of 3 to 7 mm therefrom by means of supporting spacers 13. The assembly composed of the scraper 7 and the flat coil 9' is located at a position at which the developer, having undergone the developing process and having been thereafter scraped from the sleeve or developer carrying means 2 by the scraper 7, is immediately fed to the flat coil 9' in a steady and uniform flow as rectified by the fluffing or thickness regulator plate 10. Furthermore, the coil 9' is substantially insusceptible to the influence of the permanent magnets constituting the magnetic assembly 1 because of a relatively large distance to the permanent magnets which are usually disposed at the right-hand side within the sleeve 2 (as indicated by the imaginary lines in FIG. 7) so as to serve most effectively for the transportation of the developer from the container 3 onto the rotating sleeve and thence to the developing station. As described above, the flat coil assembly may be implemented in the known form of the configuration shown in FIG. 4, or alternatively constituted by a printed coil. The supporting spacer 13 may be made of a plastic material or a metallic material.

With the arrangement of the flat coil 9' described above, the developer scraped from the rotating sleeve or developer carrying means 2 by means of the scraper 7 will pass by the flat coil 9' along both side surfaces thereof and the developer will then drop into the developer container 3. Thus, a detection sensitivity twice as high as that of the prior art arrangements shown in FIGS. 2 to 5 can be attained by virtue of the fact that use is made of both side surfaces of the flat coil 9' for detecting or regulating the toner density. Furthermore, a rapid response in measurement can also be attained because the flat coil 9' is positioned in a belt-like flow of the developer scraped from the sleeve 2 immediately after development. The system for deriving the signal representative of the toner density from the variation in the inductance of the coil 9' has been heretofore known (refer to Japanese Laid-Open Patent Exposure No. 49437/1978, for example). Accordingly, further description of the signal processing system wll be unnecessary.

Figure 8:
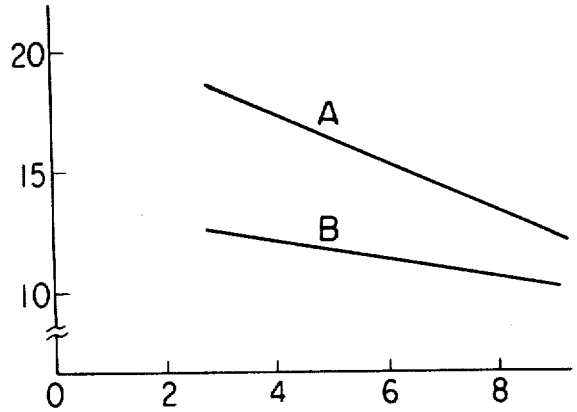

Experiments conducted by the inventors of the present application have shown that when the variation in inductance of the coil 9' arranged in the manner described above is converted into a corresponding variation in voltage, variation of 1% in the toner density (ratio of toner in weight to a sum of the toner and carrier in weight) brings about a voltage variation of about 0.6 volts. In contrast, a peak-to-peak value of noise signal is at 0.1 volts at maximum. Thus, measurement control can be effected with a high degree of accuracy. In FIG. 8, relationships between the toner density and the signal voltage are graphically illustrated. In the Figure, curve A represents measurements obtained in a toner density detector system according to the present invention, while curve B represents the results attained in the prior art system in which use is made of only one side surface of the flat coil. It will be seen that the detection system according to the present invention exhibits an improved sensitivity. Furthermore, it has been found that the system according to the present invention is insusceptible to variations or changes in ambient temperature, humidity, quantity of the developer, rotational speed of the sleeve and the thickness of the developer layer fluffed around the sleeve 2.

Figure 9:
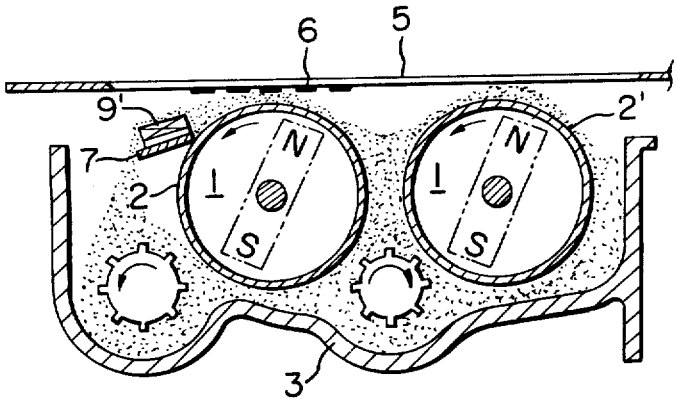
FIG. 9 is a schematic side view showing another type of developing apparatus to which the present invention can be applied.

The detection apparatus according to the present invention can be equally applied to the developing apparatus which incorporates therein a pair of rotatable sleeves 2 and 2' in an arrangement illustrated in FIG. 9 and additionally may be used in developing systems of types other than the magnetic brush type developing process described hereinbefore so long as a uniform flow of a developer of a magnetic property is available.

Because of reduced size and simple structure, the toner density detecting system according to the invention can be installed easily in existing developing apparatus with only slight modification.

What is claimed is:

1. In an improved apparatus for detecting the density of toner in a developer for an electrostatic recording apparatus which includes an operatively movable surface for carrying developer onto an electrostatic latent image bearing member during image development, and a scraper element having at least a flat surface, disposed in contact with the movable surface for scraping developer therefrom and for directing along the flat surface of the scraper element a substantially steady and uniform stream of the developer scraped from the movable surface, the improvement comprising:

a substantially flat detection coil assembly having oppositely-directed faces; and means for mounting said coil assembly on and in spaced apart relation to the flat surface of the scraper element and adjacent the movable surface such that said oppositely-directed faces are arranged substantially parallel to the flat surface and to the stream of scraped developer and such that the stream of developer is passed along both said coil assembly faces directly after being scraped from the movable surface whereby the toner density detection sensitivity of said coil assembly is significantly enhanced.

2. In an improved apparatus according to claim 1, the movable surface being a rotatable sleeve disposed about a relatively stationary magnet assembly.

3. In an improved apparatus according to claim 1, said mounting means comprising at least a supporting spacer formed of a plastic material and and connecting said coil assembly and the flat surface fo the scraper element.

4. In an improved apparatus according to claim 1, said coil assembly being spaced from the flat surface of the scraper element by a distance of between 3 and 7 millimeters, inclusive.

* * * * *